United States Patent [19]

Hennessee

[11] 4,361,964

[45] Dec. 7, 1982

[54] LAY OUT SQUARE

[76] Inventor: John W. Hennessee, 919 S. 8th, Lawton, Okla. 73501

[21] Appl. No.: 240,101

[22] Filed: Mar. 3, 1981

[51] Int. Cl.[3] ..... B43L 7/06

[52] U.S. Cl. ..... 33/478; 33/481; 33/174 G

[58] Field of Search ..... 33/478–481, 33/197, 458, 415–417, 174 G, 180 R

[56] References Cited

U.S. PATENT DOCUMENTS

| | | | |
|---|---|---|---|
| 74,297 | 2/1868 | Burnett | 33/415 |
| 1,332,768 | 2/1920 | Simmons | 33/197 |
| 1,665,400 | 4/1928 | Bittner | 33/174 G |
| 3,169,320 | 2/1965 | Currie | 33/180 R |
| 4,212,108 | 7/1980 | Jackson | 33/174 G |

*Primary Examiner*—Harry N. Haroian

*Attorney, Agent, or Firm*—Kanz & Timmons

[57] ABSTRACT

This invention relates to a lay out square which can be folded from a flat position for storage to a position wherein the legs are substantially perpendicular to each other. A body comprising first and second legs spaced apart equal distances form a U-shaped member which is joined to a face marking portion formed by third and fourth legs aligned where first and second legs and having hinge means to pivotally secure the body portion to the body at substantially right angles.

4 Claims, 5 Drawing Figures

LAY OUT SQUARE

DESCRIPTION

1. Technical Field

My invention relates to a folding lay out square which is particularly adapted to aid carpenters in laying out the location of wall connecting members known as tees and corners commonly used in wood construction.

The device permits the marking of several plates to be used in constructing the wall at one time providing for accurate location of the members which permits a more uniform construction of the building. The device is particularly adapted to allow marking the face and edge of the plate such that the assembler can place studs and cripple in their proper location for locating corners, adjoining partitions, windows and doors.

2. Background Art

U.S. Pat. Nos. 363,321, 459,446, 551,839, 844,205 and 1,649,282 discloses numerous folding squares wherein the legs of the square folds in the same plane to permit various angles to be marked in a controlled position. None of the squares fold in opposed planes or right angular planes to permit marking on two different surfaces.

DISCLOSURE OF INVENTION

In accordance with the present invention, I have designed a lay out square having first and second legs having width equal to the edge of the construction member such as a two-by-four which has a nominal width of $1\frac{1}{2}$ inches by $3\frac{1}{2}$ inches. First and second legs are long enough to mark the edges of five or six members joined by an end member. The end member preferably has indicia thereon indicating the width having a first marking notch marked at $1\frac{3}{4}$ inches or $\frac{1}{2}$ the width of the two-by-four and a second marking notch at $3\frac{1}{2}$ inches for the width of the two-by-four. The leg members of the square are spaced apart a distance equal to the width of a two-by-four or $1\frac{1}{2}$ inches. Third and fourth legs are equally $1\frac{1}{2}$ inches spaced $1\frac{1}{2}$ inches and joined by an end member forming a U-shaped member. Hinge means join the first and third legs and second and fourth legs to permit folding of the device from a position wherein the third and fourth legs overlay the first and second legs to form a substantially flat member for carrying to wherein the third and fourth legs are substantially perpendicular to the first and second lewgs and locked in position for marking and using the square.

Therefore, three spaces may be marked on the plates as they are layed out for positions of doors, windows, corners and tees. Several plates may be marked at one time thus eliminating errors which may occur in marking the single plate at a time. The face of the plate, as well as the edge, may be marked to permit accurate alignment of the studs and cripples and an easily readable marking for those carpenters assembling the wall sections.

A primary object of the invention is to provide a square which can be readily used in standard home and wood construction to permit the location of corners, tees, windows, and doors and accurately mark the locations on the plates prior to assembly to permit multiple wall sections to be accurately marked with the minimum of mismarkings and disalignment.

A still further object of the invention is to provide a square which the lay out carpenter may utilize which folds into a flat convenient, easy to carry configuration.

Other and further objects will become more apparent upon studying the detailed description hereinafter following and the drawings annexed hereto.

BRIEF DESCRIPTION OF THE DRAWINGS

The details of my invention will be described in connection with the accompanying drawings, in which.

BEST MODE FOR CARRYING OUT THE INVENTION

Most wood construction used in housing and small buildings, wall sections are formed two-by-fours which have an actual width of $1\frac{1}{2}\times3\frac{1}{2}$ inches. The vertical members which supports the wall sections are referred to as studs and horizontal members referred to as bottom and top plates and the plates are usually nailed to the ends of the studs to form the wall sections. Where a door or window occur, the stud will generally have a shorter stud referred to as a cripple for supporting a header across the opening. The header is a member which has enough strength to support the wider wall section for placement of doors or windows therein. Generally the studs are equally spaced on certain spacings known as 16 inches, 24 inches.

In constructing wall sections, the positions of the various studs are generally marked using either a steel square or a tape. Where a wall intersects another wall at a corner, a special vertical member known as a corner is positioned therein. A corner generally comprises two studs with blocks formed in between. Where a wall intersects another wall in the middle of it, a tee is generally formed. A tee generally has two studs which are joined by blocks or another stud turned on its edge. The extra studs provide nailing surfaces for finished wallboard to be used later.

In laying out the positions, the lay out carpenter generally needs to mark corners and tees very accurately since these deterine the locations of other walls.

Figure 1:
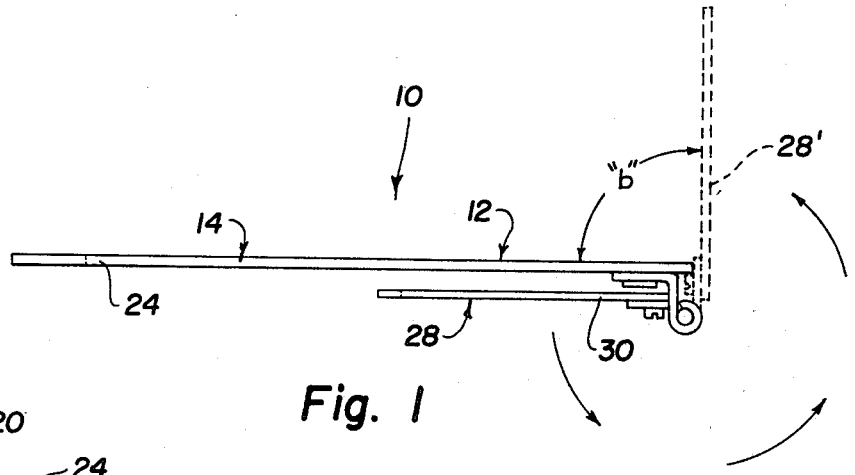
FIG. 1 is a elevational view of the lay out square showing the folded and unfolded positions.
Figure 2:
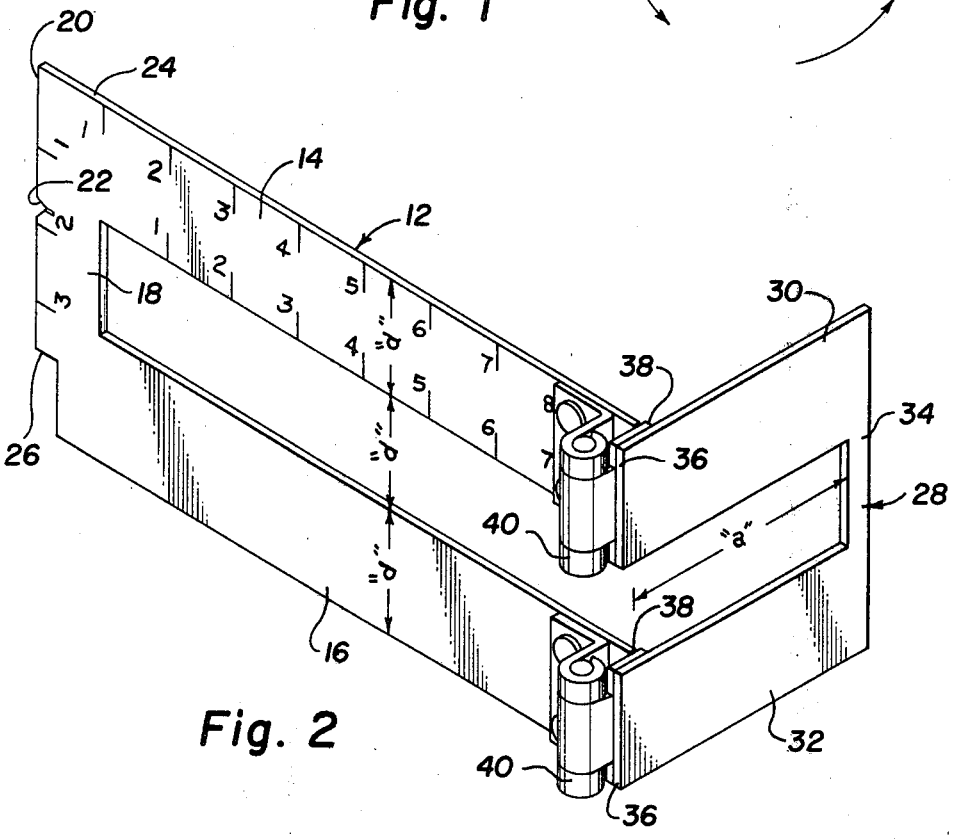
FIG. 2 is a perspective view of the unfolded lay out square.

Referring to FIGS. 1 and 2, the lay out square 10 preferrably has a body 12 having a first leg 14 and a second leg 16 joined by end member 18. The body forms a substantially U-shaped member having three equally spaced portions formed by the first and second legs 14 and 16. The width of legs 14 and 16 as shown by "d" is preferrably the edge width of the members being used. Currently the width of the edge of the two-by-four is $1\frac{1}{2}$ inches; therefore, the spacing between legs 14 and 16 will be $1\frac{1}{2}$ inches and the width of the legs 14 and 16 would be $1\frac{1}{2}$ inches also. Legs 14 and 16 are preferrably between 8 and 10 inches long to allow marking of the plurality of plates simultaneously.

Indicia may be formed on one or more of the legs to permit a short ruler for ease and convenience of use. End member 18 has an edge 20 on the outer end thereof having a first marking notch 22 $1\frac{3}{4}$ inches from edge 24 of leg 14. $1\frac{3}{4}$ inches is equal to one-half the width of the face of a two-by-four and $3\frac{1}{2}$ inches is equal to the width of the two-by-four in a second marking notch 26 is formed along edge 20 as will be more fully explained hereinafter. These marking notches 22 and 26 make it easy to locate the centers of walls and marked corners.

A face marking portion 28 of the lay out square 10 is formed by third and fourth legs 30 and 32 joined by end connector 34. Legs 30 and 32 are equally spaced to align with legs 14 and 16 being $1\frac{1}{2}$ inches wide and spaced apart $1\frac{1}{2}$ inches. The dimension "a" is preferrably at least $3\frac{1}{2}$ inches to permit full width marking of the face plate. Ends 36 of legs 30 and 32 extend adjacent to ends 38 of legs 14 and 16.

Means for pivotally securing body 12 to face marking portion 28 permits movement of the face marking portion 28 from an overlaying position wherein the lay out square is substantially flat as illustrated in FIG. 1 to a position in dashed outline 28' wherein angle "b" is substantially 90 degrees. The means also locks the device into the right angular position. Such as means may comprise a self-closing hinge 40 which is secured to end 38 and 36 of body 12 and face marking portion 28 respectively. A self-closing hinge 40 may comprise the type that is spring loaded to hold the body 12 perpendicular to portion 28 when the square is being used. Then by simply grasping the portion 28 and moving it against the force of the spring, the device can be flattened out as shown in FIG. 1.

Figure 3:
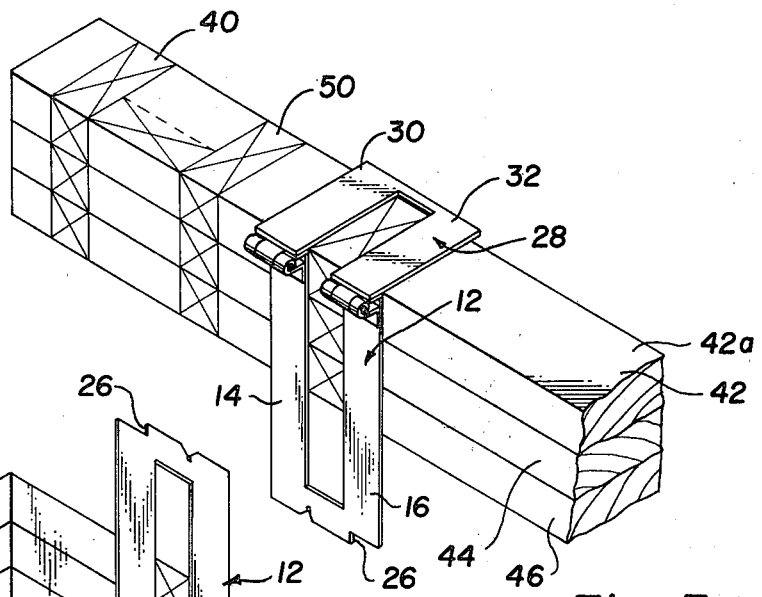
FIG. 3 is a perspective view showing the marking of several plates.
Figure 4:
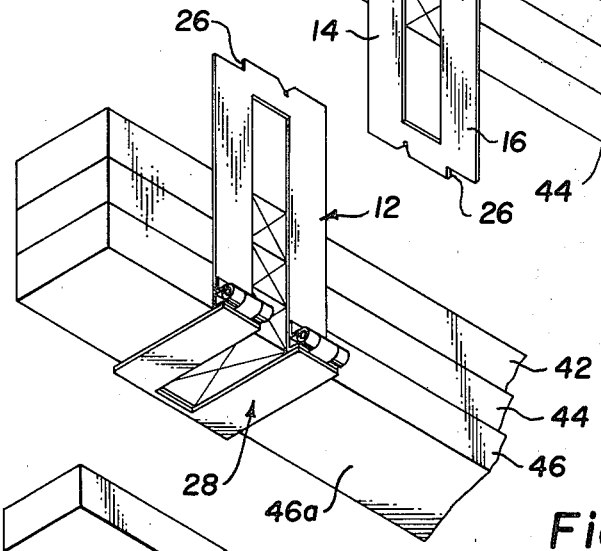
FIG. 4 is a view showing markings on the bottom of the face of same plates.
Figure 5:
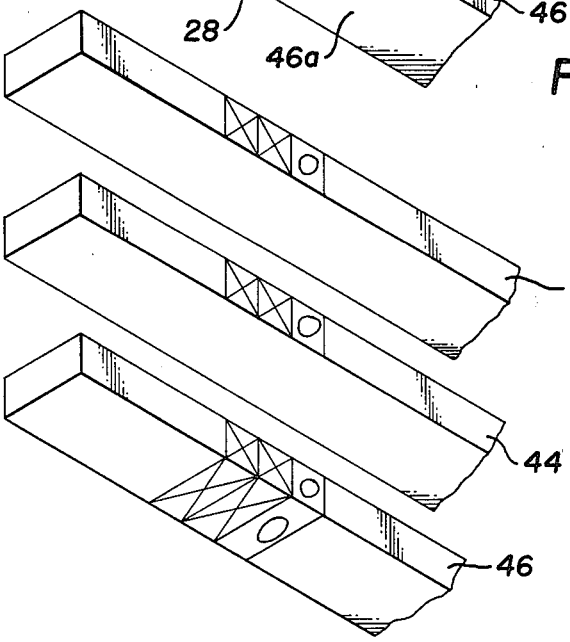
FIG. 5 is a view showing the plates as marked.

As illustrated in FIG. 3, a number of plates 42, 44 and 46 are aligned on top of one another for wall section that are to be the same lengths. Lay out men generally use an X to indicate the position of the stud and a 0 to indicate the position of the cripple. Face marking portion 28 is secured over the face **42*a* of plate 42 and body 12 is aligned over the edges. A mark is marked with a pencil or other similar device along the edge of legs 30 and 32 and 14 and 16 for the correct position of the stud or cripple to be used. As indicated by markings 48 and 50, the space therebetween is $3\frac{1}{2}$ inches which is marked off by notch 26 to position a tee. As illustrated in FIG. 4 the device may be reversed to mark the face 46*a* and plate 46 on each of the stack of plates. As is illustrated in FIG. 5, the positions of studs can be marked on the plate as well as the cripples as shown by 0. Thus the plates are marked for accurate vertical alignment of the studs to assure that they will be plumbed when the walls are plumbed and lined. It should be readily apparent that by the length of body 12**, five or six plates may be marked. However, the device is equally adapted to mark just two plates for dealing for the single wall. Corners and tees may be easily marked with the device.

It should be readily apparent that the invention herein before discussed accomplishes each of the objects herein before described.

It should be further apparent that other and further embodiments of the invention may be devised without departing from the basic concept herein.

I claim:

1. A lay out square for use in constructing wall sections comprising:

first and second leg members having a width equal to that of the edge width of the construction members being used;

an end member joining said first and second legs to form a U-shaped member, the first and second legs being spaced apart a distance equal to the width of one leg;

third and fourth legs being equal in width to the first and second legs and being spaced to align with said first and second legs;

a connector member joining said third and fourth legs at one end; and means pivotally joining said first and third legs and said second and fourth legs to permit movement of the third and fourth legs from a position substantially aligned and overlapping said first and second legs to a position wherein the third and fourth legs are locked substantially perpendicular to the first and second legs.

2. A lay out square according to claim 1 including a first marking notch on said end member joining said first and second legs to indicate half the width of the construction members and a second notch formed on said end member indicating the full width of said construction members.

3. A lay out square according to claim 1 wherein said first and second legs are substantially longer than said third and fourth legs.

4. A lay out square according to claim 1 wherein said means pivotally joining said first and second legs and said third and fourth legs comprises a self-locking hinge adapted to lock when the third and fourth legs are substantially perpendicular to the first and second legs.

* * * * *